United States Patent [19]

Grombchevsky et al.

[11] Patent Number: 4,705,415

[45] Date of Patent: Nov. 10, 1987

[54] MATRIX PRINTER AND INKER FOR INDEFINITE LENGTH ARTICLES

[76] Inventors: Andrei Grombchevsky, 24 Lancewood Way, Irvine, Calif. 92715; Aron Kerner, 17251 Palisades Cir., Pacific Palisades, Calif. 90272

[21] Appl. No.: 818,206

[22] Filed: Jan. 13, 1986

Related U.S. Application Data

[63] Continuation-in-part of Ser. No. 700,823, Feb. 11, 1985, abandoned.

[51] Int. Cl.[4] ..... B41F 17/10; B41J 3/20; B41J 31/14; B41J 35/04

[52] U.S. Cl. ..... 400/124; 400/194; 400/213; 400/202.4; 400/248; 400/701; 101/35

[58] Field of Search ..... 101/424, 423, 93.04, 101/93.05, 35; 400/124, 211, 212, 213, 194, 701, 702, 202.4, 248

[56] References Cited

U.S. PATENT DOCUMENTS

| | | | |
|---|---|---|---|
| 2,363,817 | 11/1944 | Taylor | 101/424 X |
| 2,475,336 | 7/1949 | Petz | 400/194 |
| 2,694,362 | 11/1954 | Paige | 400/124 X |
| 3,467,232 | 9/1969 | Paige | 101/93.04 X |
| 4,011,934 | 3/1977 | Ploby et al. | 400/212 |

OTHER PUBLICATIONS

Lisinski; "Print Wire Inking System", IBM Technical Disclosure Bulletin, vol. 14, No. 10, p. 2980, 3/1972.

*Primary Examiner*—Clifford D. Crowder
*Attorney, Agent, or Firm*—Bruce A. Jagger; Natan Epstein

[57] ABSTRACT

A stationary dot matrix printer for printing both continuously variable and repetitive information on a moving substrate utilizing a continuously driven endless loop of ink absorbing web material and either a solvent laden wick to wipe the print wires or a composite web having a non ink-absorbing impact layer on the print head side of the web. A shuttle element drives the web reciprocally in a lateral direction to distribute the wear.

4 Claims, 6 Drawing Figures

Figures 1, 4, 6:
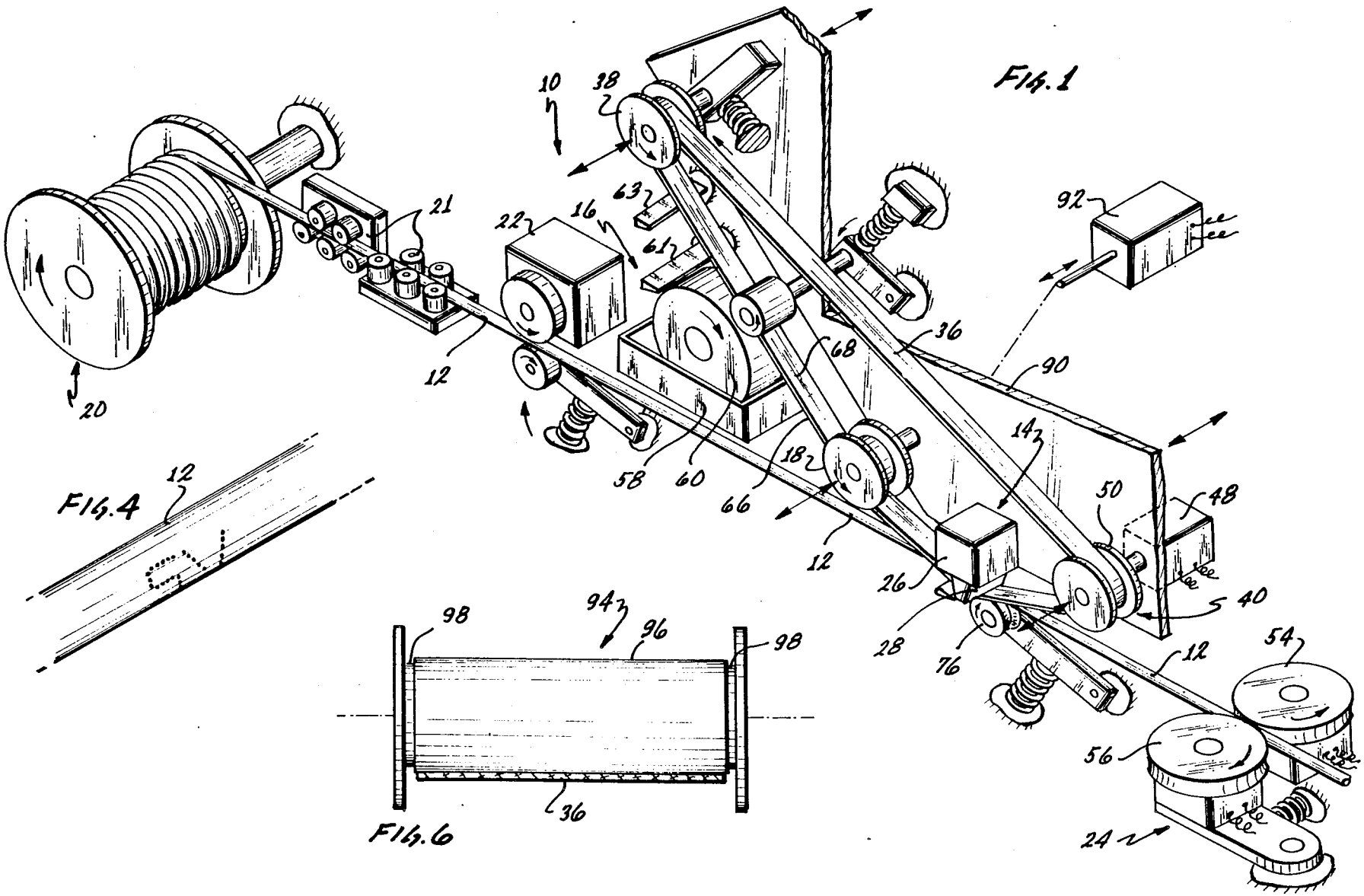

10
12
14
16
18
20
21
22
24
26
28
36
38
40
48
50
54
56
58
60
61
63
66
68
76
90
92
94
96
98

MATRIX PRINTER AND INKER FOR INDEFINITE LENGTH ARTICLES

This is a continuation-in-part patent application of Ser. No. 700,823 filed Feb. 11, 1985 now abandoned.

Previously, considerable difficulty had been experienced in printing and, in particular, in printing variable information on wire and tubing of different kinds.

Previous expedients have included laser etching machines which physically burn the outer face of the substrate which is being marked with a resultant loss in structural integrity, as well as indistinct markings on dark colored substrates. Various ink jet marking machines have been proposed, but are limited in the range of marking fluids which can be accommodated because of a tendency of the tiny ink jets to clog. Also, changing from one ink system to another requires that the ink dispensing system be thoroughly cleansed throughout. Because of the limited range of marking fluids, it has been difficult or impossible to permanently mark certain substrate materials. Further expedients have included fixed information stamps where the information to be recorded on the face of substrate is fixed and can only be changed by stopping the marking operation and replacing the marking head. Various cutting and embossing procedures have been proposed, all of which suffer from the fact that they impair the structural integrity of the substrate. Various inks which have very desirable characteristics are difficult to use because they do not adhere well to nonporous webs. Simple and efficient systems which can be operated with a minimum amount of skill, effort and attention have been sought.

These and other difficulties of the prior art have been overcome according to the present invention, wherein an efficient easy-to-use printer is provided for printing markings which are variable at will without interrupting the printing operation. The control of this system is simple and direct in that the web element moves continuously in a closed loop at a predetermined constant rate. Further, according to the present invention a wide variety of surfaces of different materials, characteristics and shapes may be printed or marked. This invention is particularly adapted to utilize inks which require the use of a porous web to support them. In general, the printing system, according to the present invention, comprises subject matter which is in the nature of a special-purpose word processor which is simple to control, uses inexpensive drives and controls and will accommodate many different arcuate and plane shapes and print receiving surfaces. The subject matter of the present invention is particularly applicable to the efficient, inexpensive application of variable markings on materials in the nature of insulated wire and tubing, and is particularly adapted for rapidly changing from one print receiving substrate to another where the substrates differ in at least one of shape or print receiving characteristics.

In general, the printing system, according to the present invention, is similar in certain respects to that which is disclosed in our U.S. Pat. No. 4,637,743, and comprises a printing station at which is located a stationary dot matrix impact printing head. The print wires in the printing head are preferably conveniently arrayed so that the impact ends of the wires define a configuration which conforms generally to the configuration of the surface or face of the print receiving substrate to which the dot matrix print is to be applied. The print receiving substrate is moved continuously past the printing station at a controlled rate which may be fixed or variable as desired, but is preferably at a predetermined constant rate. The printing is accomplished at the printing station while the face of the print receiving substrate which receives the dot matrix printing is moving. A web is provided between the impact printing ends of the print wires and the print receiving face of the substrate. The web moves in a continuous loop over web drive, support and tensioning rollers past the printing station at a constant rate. The rate may be adjusted from time to time as desired. A readily removable ink supply member is positioned so as to apply a marking fluid to one surface of the web. At the printing station the marking media which has been applied at the inking station is on the side of the web which faces the surface which is to receive the dot matrix printing. Preferably, the ink receiving face of the web is porous so that it absorbs the ink. The impact of the impacting printing ends of the print wires on the opposite side of the web element transfers the marking media to the print receiving face of the moving substrate.

The ink supply member is mounted for ready removal and replacement in the printing system so that the marking media can be changed with only a momentary interruption of operations. Likewise, the continuous loop of web is readily removable. The only loss in material which occurs during a changeover from one marking media to another is the loop of web and the marking media which is adhered thereto at the time the operation is interrupted for the marking media changeover. Since this generally represents at most only a few feet of web, the cost is generally nominal. The time required to exchange ink supply members and web loops is generally on the order of a few minutes, so the lost production time at the occasion of a marking media changeover is also generally nominal. The ability to change over quickly and easily permits the use of a wide variety of marking media, including those which have short useful lives, for example, by reason of being compounded with curable materials which have short pot lives. High viscosity marking media which require heating to achieve the desired degree to fluidity may be used if desired. Marking media which may be loaded with particulate matter with such particle sizes that they will not pass through small orifices may be utilized with various large pore sized or orifice sized applicators. Utilizing the prefered porous surfaced web permits the web to hold inks which do not readily adhere to a nonporous surface so that the range of usable marking media is expanded. The marking media may be applied to the surface of the web by means of any desired technique, including spraying, rolling, swabbing, or the like. The marking media applicator is generally demountable with the ink supply member. Thus, virtually any marking media may be accommodated rapidly, efficiently and without difficulty according to the present invention.

Optionally, various treatments such as heat, sound, light, radiation, or the like, may be applied to one or more of the web, the marking media, or the print receiving substrate for improving the characteristics of the dot matrix printing on the print receiving face of the substrate. The web may be conveniently heated so as to improve the printability of the system. Heat may also be applied to the print receiving face of the substrate so long as the degree of heat is not sufficient to impair the structural integrity of the substrate. Where the marking media includes a light or other radiation curable polymer, the curing may be effected by applying a suitable radiation source to the printing system. The virtually limitless flexibility of the printing system, according to the present invention, permits the efficient marking of even very difficult to mark materials such as polyflurocarbons and silicone polymers.

The use of a dot matrix printing head permits virtually unlimited instantaneous control over the information to be printed on the print receiving face of the substrate. This control is achieved through the application of conventional word processing program techniques. The printed information which can be continuously varied at will includes alphanumeric information, figures, designs, bar codes, and the like. The printed information may be varied as desired without interrupting the operation of the printing system.

The entire operation is conveniently controlled by conventional control means so that the various web drive and substrate supply and takeup stations are coordinated in their operations with the printing station. The printing system is controlled so that the web moves continuously at a constant predetermined rate in the same direction as the moving substrate. The web is preferably moved reciprocally in a lateral direction as it moves past the printing station so that the impact of the print head is distributed uniformly over the web element. This substantially reduces the amount of web which is consumed in the operation of the printing system according to the present invention. The use of a three foot long web element which is preferably from about one to four inches wide combined with a reciprocating lateral movement provides a system which will operate continuously for approximately six to eight hours before the web loop wears to the point where it requires replacement.

The present printing system with its ability to print a continuously variable message on a constantly running substrate, and its ability to rapidly change marking media to provide any desired characteristics in the printed information, is ideally suited to efficiently processing small quantities of specialized wire or tubing. The simplicity of the control and drive systems permits the construction of an inexpensive machine which can be operated with a minimum of attention and effort. Readily interchangeable printing heads which provide different configurations for the shapes defined by the impact printing ends of the print wires may be provided to accommodated various shapes of print receiving faces. This feature is particularly advantageous where large variations in the diameter of tubing or wire occurs from one production run to the next. The printing head is preferably detachably mounted so that it is quickly and conveniently changeable in like manner as the ink supply member. The dot matrix print head is constructed utilizing conventional dot matrix impact printing head technology except with regard to the wick arrangement described herein.

When an entirely porous web is utilized, the print wires become contaminated with ink. The ink for a variety of reasons frequently causes the print wires to stick in their bushings or guides and otherwise interferes with the proper operation of the print head. In order to avoid this problem, a solvent laden wick is provided which wipes the wires clean of ink on each stroke. The wick is generally in contact with a body of solvent for the ink so the wick is continuously wet with ink solvent.

As an alternative to the use of an entirely porous web, the print wires may be conveniently protected from ink contamination by the use of a composite web in which the ink receiving surface is porous, for example, a ribbon of woven fabric, and the print head side is rendered ink impervious plastic, for example, by means of a ribbon of plastic which is preferably elastomeric. The two ribbons are conveniently adhered together. The composite web may be prepared by impregnating one side of a fabric ribbon with plastic or by rendering one side of an elastomeric plastic ribbon porous. Also two separate preformed ribbons may be joined together. Preferably the joinder of the porous ribbon and impervious film is permanent. Preferably the impervious barrier is elastomeric and very thin so that the characteristics of the print are not significantly impaired by the presence of this ink impervious film layer.

The reciprocating lateral movement of the ribbon is generally coordinated so that the impact of the print head is distributed uniformly over the entire web element. The continuous loop of web is supported by rollers which are simultaneously reciprocably movable laterally to the direction of movement of the web element thereby to distribute the printhead impact uniformally over the web element width. The rollers or pulleys supporting the continuous web loop are cylindrical, having an axial length substantially equal to the web width. The roller has clearance at each end to allow the ribbon to center itself on the roller.

It is known in the art to make pulleys or rollers for ribbons with a convexly curved roller surface, i.e., the roller being a greater diameter at its center than at either end in order to maintain the ribbon centered on the roller surface. It has been found, however, that when very thin and soft ribbons are used with such convexly curved rollers, the ribbon tends to bunch in the middle, as the centering forces acting inwardly from the opposite edges of the roller are greater than the stiffness of the ribbon material so that it folds or corrugates longitudinally along its middle on the roller surface. This problem is overcome in the present invention by providing cylindrical ribbon pulleys or rollers having a clearance space at each end defined by a roller end portion of slightly reduced diameter relative to the diameter of the main, central roller surface. As the ribbon moves axially along the roller surface and its edge slips off the main roller surface into the step defined by the reduced diameter end portion, centering forces come into play tending to return the ribbon towards the main roller surface. The centering forces do not cause bunching of the ribbon due to the cylindrical main roller surface.

Referring particularly to the drawings for the purposes of illustration only, and not limitation, there is illustrated at:

FIG. 1, a perspective view of a preferred printing system adapted for printing on a wire and tubing wherein the web supporting rollers are jointly reciprocable transversely to the web movement.

Figure 2:
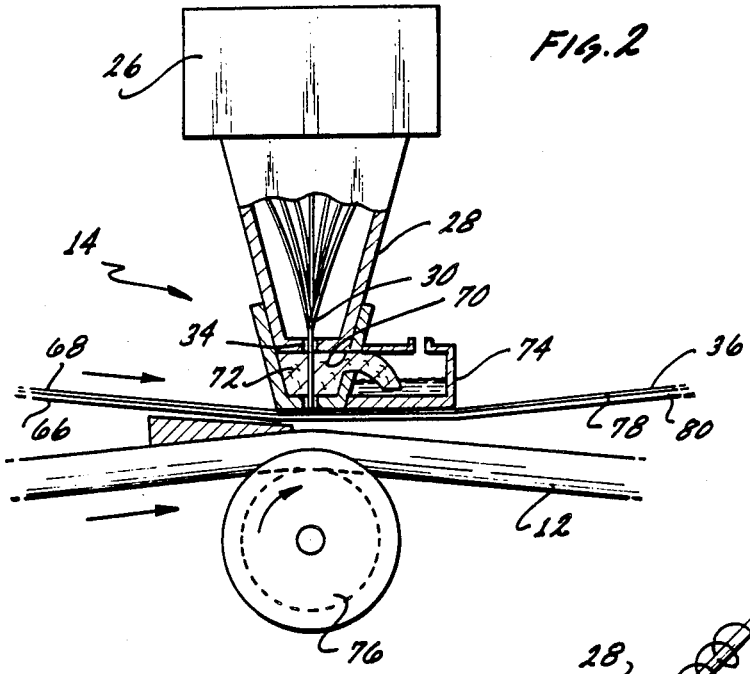
Figure 3:
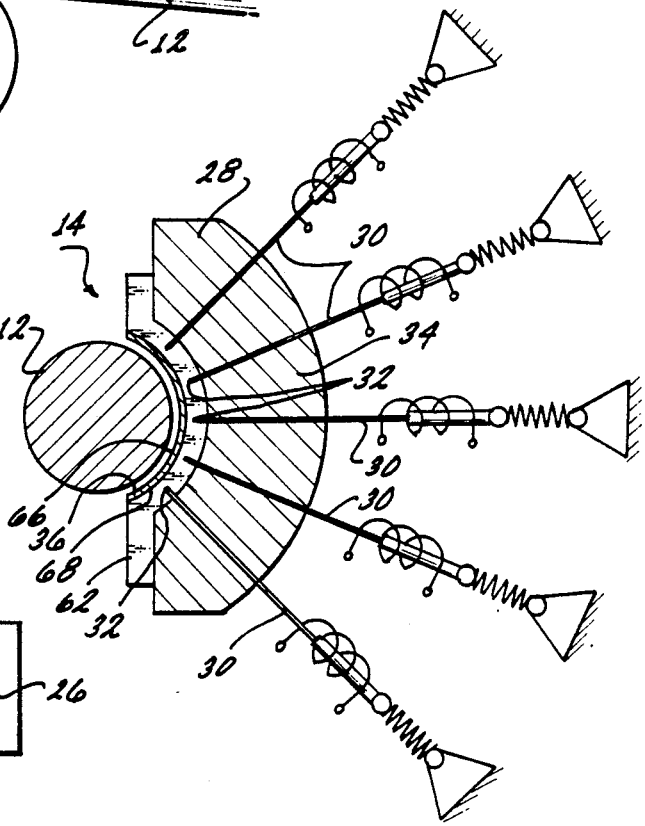
Figure 5:
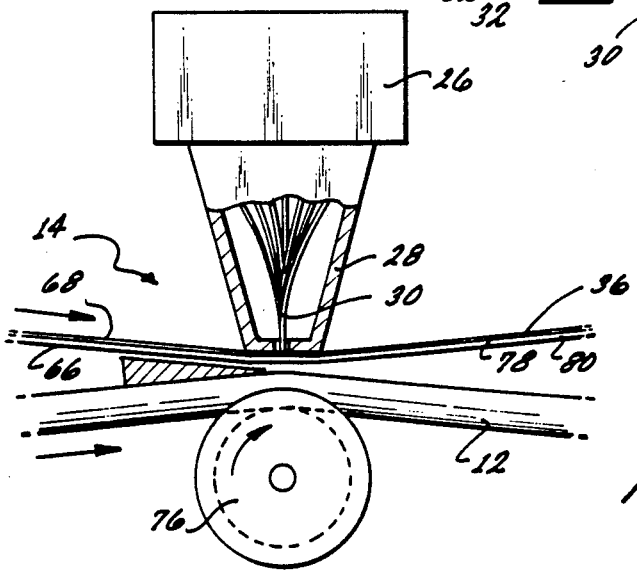

FIG. 2, a broken cross-sectional view of an embodiment of a printing station in which the print wires are wiped by a solvent wetted wick;

FIG. 3, a cross-sectional view of a printing station utilizing a foil guide to configure the foil to fit the print receiving face of the substrate;

FIG. 4, a perspective view of a round wire having dot matrix printing imprinted on the face thereof; and FIG. 5, a partial cross sectional view of a preferred embodiment in which a composite porous-impervious web element is utilized.

FIG. 6, a longitudinal view of an improved web support roller.

Referring particularly to the drawings, there is illustrated generally at 10, a printing system which is particularly adapted to applying dot matrix printing on a continuously moving elongated cylindrical substrate 12. The printing system 10 includes a printing station indicated generally at 14 and an ink supply station indicated generally at 16. Substrate 12 is delivered to the printing system 10 from substrate supply reel 20 through straightener 21, encoder 22 past printing station 14 and to takeup drive 24. The transport system for the substrate 12 which comprises the supply reel 20, encoder 22, and takeup drive 24 comprises various conventional electric motor drives which are coordinated by control system 26. Control system 26 is electrically connected, through connections which are not illustrated, to the various drives of printing system 10 through conventional electrical circuitry. Pneumatic, mechanical or hydraulic operating systems and controls may be employed if desired, however, electrical controls are generally preferred. Control system 26 also includes conventional word processing facilities for controlling the operation of dot matrix impact printing head 28. Dot matrix impact printing head 28 includes magnetically driven, spring biased print wires 30, which are constructed according to conventional dot matrix printing head techniques. Each of the print wires 30 is provided with an impact end 32. Each of the print wires 30 is mounted for reciprocal motion in bushings or guides in block 34. Printing head 28 is detachably mounted at printing station 14, so as to permit easy removal and remounting for maintenance and configuration change purposes.

Web 36 moves in a continuous loop from web tensioning roller 38 past ink supply station 16, web positioning roller 18, and printing station 14 to web drive station 40, and back to web tensioning roller 38. Web drive station 40 includes drive motor 48 and drive roller 50. Tensioning roller 38 is spring biased in a direction to tension web 36. Drive roller 50 is driven continuously at a constant rate by drive motor 48. The action of the drive and tensioning rollers combined with the positioning roller and reciprocating rollers 18, 38 and 40 is such that foil 36 advances past printing station at a continuous predetermined rate and predetermined position. The speed of motor 48 may preferably be controlled by control system 26 so that the rate at which web 36 is moving codirectionally with substrate 12 is the same as the rate at which the substrate 12 is moving. The length of the loop of web 36 is generally less than about three feet. Similarly, the substrate transport system includes a substrate takeup drive 24 which is comprised of a pair of motor pulley combinations 54 and 56. Motor pulley combination 56 is spring biased into contact with substrate 12 so as to grip the substrate between the pulleys of the motor pulley combinations 54 and 56, respectively. The motor pulley combinations 54 and 56 act to pull substrate 12 past printing station 14 at a predetermined rate. The movement of substrate 12 under the urging of elements 54 and 56 actuates encoder 22 which transmits the information of the travel of substrate 12 to control system 26 through conventional electrical circuitry which is not shown. This co-rate co-directional movement of web 36 and substrate 12 permits print head 28 to be activated with a frequency proportional to the linear speed of substrate 12. This gives substantially the same shade of characters imprinted on the substate over a wide range of substrate movement speeds. Production rates can be adjusted to accommodate other requirements without impairing quality.

Supply station 16 includes a readily detachable marking media container 58, and a marking media applicator 60. In the embodiment chosen for illustration, the marking media applicator 60 is in the form of a roller. A doctor blade 61 is provided to prevent the build up of ink on roller 60. A cleaning blade 63 cleans excess ink from web 36 just prior to applicator 60. Foil guide 62 serves to configure the foil 36 to the form desired for usage at printing station 14. Foil guide 62 configures foil 36 into a semicircular form in the embodiment illustrated particularly in FIG. 3. Marking media applicator 60 is combined with and is removable with marking media container 58. A complete change in the marking media system may be accomplished merely by removing marking media container 58 and replacing it with an equivalent container which is set up with the desired marking media and applicator. As web 36 advances past ink supply station 16, applicator 60 applies marking media to a first surface 66 of web 36. At printing station 14 the inked first surface 66 is positioned relative to the print receiving face of substrate 12 so that the impact of impact ends 32 on the second surface 68 of web 36 causes the marking media to be transferred from web 36 to the print receiving face of substrate 12. The result is indicated particularly in FIG. 4 where dot matrix impact generated printing is illustrated on the print receiving face of substrate 12.

The web support rollers 18, 38 and 40 are rotatably mounted on a common plate 90 which is mounted by any suitable means for linear movement along a direction parallel to the axes of the three rollers 38, 18 and 40, i.e., a direction parallel to the width of the web 36 and transverse to the direction of continuous movement of the web loop. The roller mounting plate 90 is reciprocable along this transverse direction by means of a linear actuator 92 which may be a suitably constructed gear motor, hydraulic device, a solenoid device or any equivalent suitable means for applying reciprocating force to the plate 90 along the direction of movement of the same. The web rollers 18, 38 and 40 are advantageously constructed as shown in FIG. 6 for use with very thin and pliable web material. The roller 94 has a main roller surface 96 which is cylindrical in shape, i.e., the roller surface 96 is flat along an axial direction and its axial width is substantially equal or slightly greater than the width of the web 36. At each end of the main roller surface 96 is an end roller portion 98 of slightly reduced diameter which defines a step at each end of the main roller surface. The height of this step, i.e., the difference between the diameters of the main roller surface and the end roller portions 98 may be quite small, e.g., of the order of 0.01–0.02 inches. It has been found that such a small clearance at each end of the main roller surface 96 is effective in maintaining a very thin web 36 centered on the main roller surface 96 without bunching along the web width and such roller construction is preferred for the three rollers 18, 38 and 40 whenever thin, pliable web material is used.

As illustrated particularly in FIG. 3 the print needles are preferably mounted in guide channels block 34 so that the impact ends 32 are arrayed in a configuration which at least generally approximates the contour of the print receiving face of substrate 12. Conforming the configuration defined by impact ends 32 to the general configuration of the print receiving face contributes significantly to the readability of the resultant print, particularly where the diameter of substrate 12 is small. In the embodiment illustrated particularly in FIG. 3, the impact ends 32 all travel approximately the same distance from their at rest positions to the point of impact with the print receiving face of substrate 12. For rapidly moving substrates, this contributes significantly to the readability of the print on the face. Conforming the shape of web 36 to the same general configuration as the face of substrate 12 also contributes to the improved characteristics of the print.

The nature of the web may be varied as desired to suit the particular requirements of the printing operation which is to be accomplished. The first surface of web 36 may be treated in any desired manner to enhance printability. In general, web first surface 66 is uncoated, however, coatings of various kinds may be provided if desired.

In an embodiment where web 36 is a woven cloth ribbon which is pervious throughout the print wire cleaning wick and solvent reservoir structure illustrated particularly in FIG. 2 is preferably used. Print wires 30 are lengthened so as to accommodate passing through a wicking chamber 70 which contains a wick 72 and is positioned between the printing head 28 and web 36. A portion of wick 72 extends into solvent reservoir 74 where an ink solvent is provided to maintain wick 72 in a continuously wetted state. The presence of continually wetted wick 72 in continual wiping contact with print wires 30 during every stroke prevents ink from entering the bushings in block 34. Support roller 76 serves to stabilize and accurately position substrate 12 at printing station 14.

The practice of the invention utilizing an imperviously backed web is illustrated, for example, in FIG. 5 where a web 36 with a nonporous, preferably elastomeric, layer 78 is provided on the print head side 68 and a woven fabric ribbon 80 is provided on the ink receiving side 66. The elastomeric film 78 is very thin so that the quality of the printing is not significantly changed by its presence. This arrangement is preferred where highly corrosive or abrasive inks are used.

The teachings of the present invention are not limited to substrates with generally cylindrical configurations. Other arcuate or plain configurations or combinations thereof are readily printed according to the present invention by utilizing appropriately configured printing heads.

As will be readily understood by those skilled in the art, what has been described are preferred embodiments in which modifications and changes may be made without departing from the spirit and scope of the accompanying claims.

What is claimed is:

1. A printer for printing both variable and repetitive information on a moving surface as such surface passes by a printing station, said printer comprising:

stationary dot matrix impact printing means for imprinting markings on a face of a moving substrate at a printing station;

substrate transport means for transporting said substrate past said printing staton in a first direction at a controlled rate;

web transport means for transporting a continuous loop of web element in said first direction at a constant rate past said printing station between said face and said printing means including a plurality of roller means having support surfaces for said web element and means for simultaneously reciprocally moving said plurality of roller means laterally of said first direction relative to said stationary printing means without interrupting transport movement of said web element; and detachable inking means for applying a marking media to a first surface of said web element, said first surface being disposed in position to contact said face responsive to the action of said printing means whereby said marking media is transferred from said web element to said face at said printing station; and control means for permitting continuous variation in said markings without interrupting said operation.

2. A printer for printing both variable and repetitive information on a moving surface as such surface passes by a printing station, said printer comprising:

stationary dot matrix impact printing means for imprinting markings on a face of a moving substrate at a printing station;

substrate transport means for transporting said substrate past said printing station in a first direction at a controlled rate;

web transport means for transporting a continuous loop of web element in said first direction at a constant rate past said printing station between said face and said printing means, said web transport means including at least one web drive member and at least one web tensioning member;

detachable inking means for applying a marking media to a first surface of said web element, said first surface being disposed in position to contact said face responsive to the action of said printing means whereby said marking media is transferred from said web element to said face at said printing station; and control means for permitting continuous variation in said markings without interrupting said operation;

said stationary dot matrix impact printing means including a print head having a plurality of print wires, each of which terminates in an impact printing end disposed for reciprocal movement in a guide element defined in said print head, and wick means for wiping ink from said print wires ends, said wick means being mounted between said print head and said web element thereby to prevent clogging of said guide elements with ink lifted from said web element.

3. A printer of claim 2 further comprising a solvent reservoir, said wick means extending into said reservoir for absorbing ink solvent therefrom for improved wiping action.

4. A printer for printing both variable and repetitive information on a moving surface as such surface passes by a printing station, said printer comprising:

stationary dot matrix impact printing means for imprinting markings on a face of a moving substrate at a printing station;

substrate transport means for transporting said substrate past said printing station in a first direction at a controlled rate;

web transport means for transporting a continuous loop of web element in said first direction at a constant rate past said printing station between said face and said support surfaces for said web element and means for simultaneously reciprocally moving said plurality of roller means laterally of said first direction relative to said stationary printing means without interrupting transport movement of said web element; and detachable inking means for applying a marking media to a first surface of said web element, said first surface being disposed in position to contact said face responsive to the action of said printing means whereby said marking media is transferred from said web element to said face at said printing station; and control means for permitting continuous variation in said markings without interrupting said operation;

said detachable inking means including applicator means cooperating with said web element and curved foil guide means for pre-shaping said web element to a curvature suitable for printing on a generally cylindrical substrate surface.

* * * * *